US006210348B1

(12) United States Patent
Reed

(10) Patent No.: US 6,210,348 B1
(45) Date of Patent: Apr. 3, 2001

(54) POWER OPERATED STRETCHING APPARATUS

(75) Inventor: Michael S. Reed, Scottsdale, AZ (US)

(73) Assignee: Stretch Power, LLC, Scottsdale, AZ (US)

( * ) Notice: Subject to any disclaimer, the term of this patent is extended or adjusted under 35 U.S.C. 154(b) by 0 days.

(21) Appl. No.: 09/439,172

(22) Filed: Nov. 12, 1999

Related U.S. Application Data

(62) Division of application No. 09/044,362, filed on Mar. 19, 1998, now abandoned.

(51) Int. Cl.[7] ..... A61H 1/02
(52) U.S. Cl. ..... 601/23; 482/72
(58) Field of Search ..... 482/72, 73, 114, 482/115, 127, 120–122, 125, 129, 907; 601/23; 242/390.8, 390.9

(56) References Cited

U.S. PATENT DOCUMENTS 2,512,911 * 6/1950 Benice ..... 482/72
4,621,623 * 11/1986 Wang ..... 482/72
4,647,035 * 3/1987 Yellen ..... 482/131
4,846,461 * 7/1989 Robards, Jr. et al. ..... 482/72
4,966,363 * 10/1990 Van Der Hoeven ..... 482/140
5,226,867 * 7/1993 Beal ..... 482/127
5,360,382 * 11/1994 Chi ..... 482/1
5,449,336 * 9/1995 Sabel ..... 482/133
5,480,375 * 1/1996 La Fosse et al. ..... 601/23
5,601,527 * 2/1997 Selkowitz ..... 601/23
5,645,514 * 7/1997 Chen ..... 482/72
5,707,322 * 1/1998 Dreissigacker et al. ..... 482/72
5,728,034 * 3/1998 Lamothe ..... 482/131
5,876,310 * 3/1999 Mackey et al. ..... 482/74

* cited by examiner

*Primary Examiner*—Justine R. Yu
(74) *Attorney, Agent, or Firm*—LaValle D. Ptak

(57) ABSTRACT

An exercise device for stretching the lower back and leg muscles of a user includes a flexible cable located between a foot rest portion and a handle member. The handle member is designed to be grasped by the hands of a user; and the cable is fixedly attached to one or the other of the foot rest or the handle. The other end of the cable is attached to a rotatable reel; and a motor is provided for operating the reel to wind up the cable to reduce the distance between the handle and the foot rest at a predetermined rate. Controls are provided for controlling the operation of the motor and for controlling its direction of operation. In some embodiments, the motor is a battery-operated motor located within the handle member, which also includes batteries for operating the motor.

13 Claims, 4 Drawing Sheets

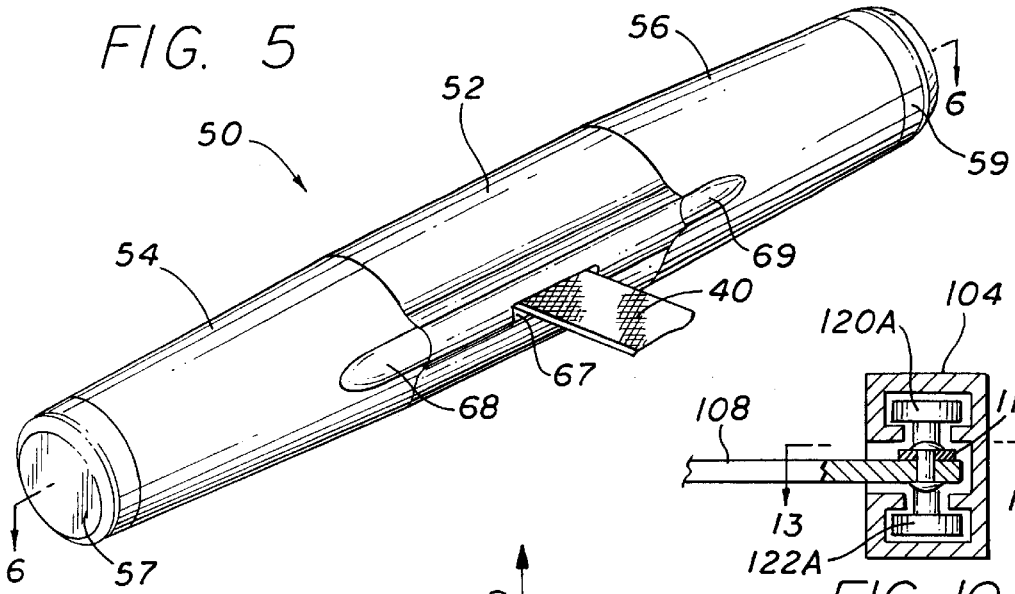
FIG. 10
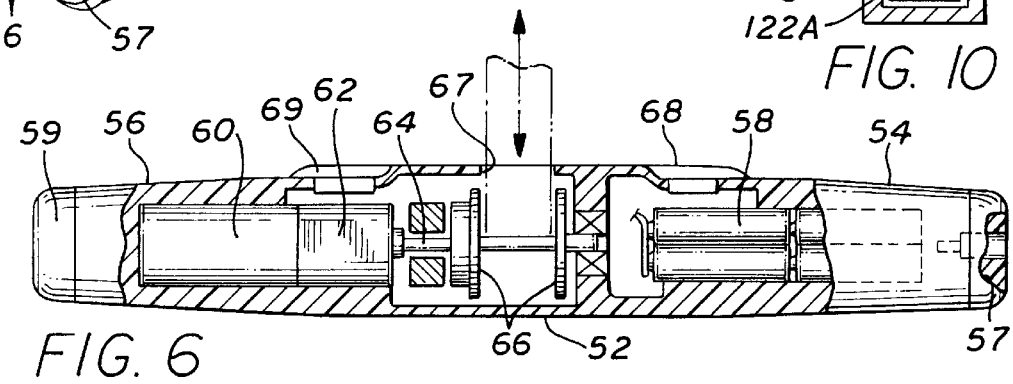
FIG. 6
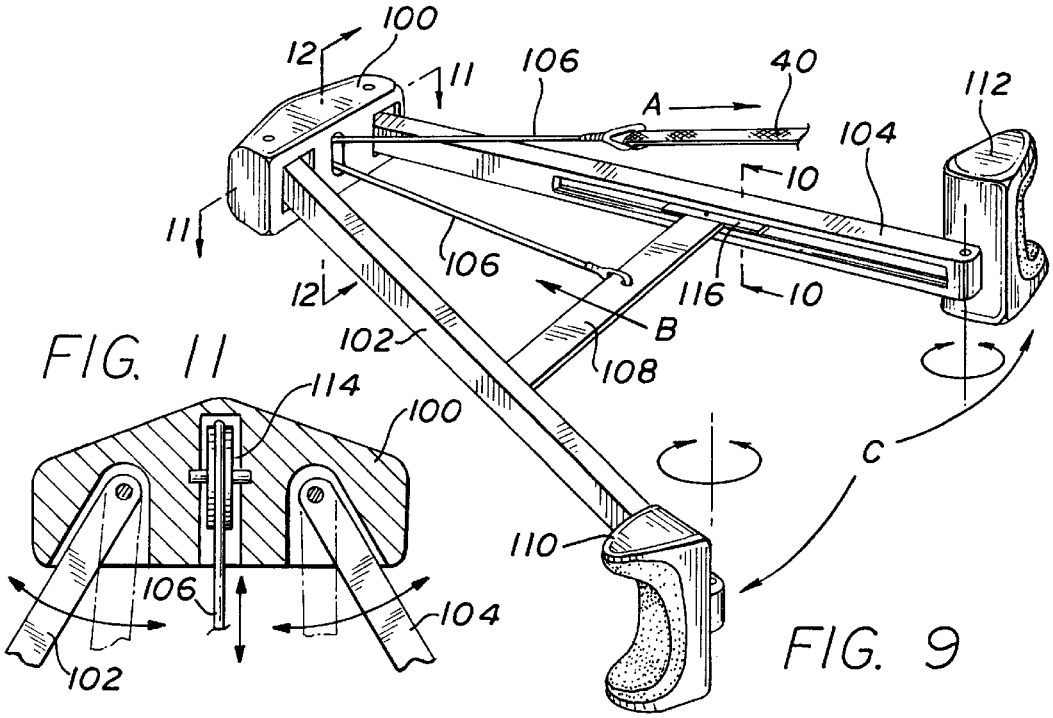
FIG. 11
FIG. 9

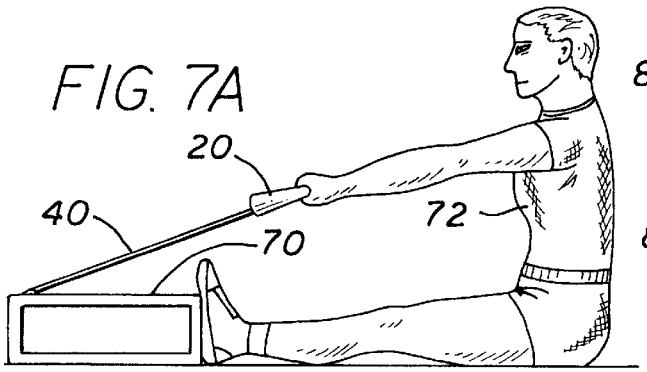
FIG. 7A
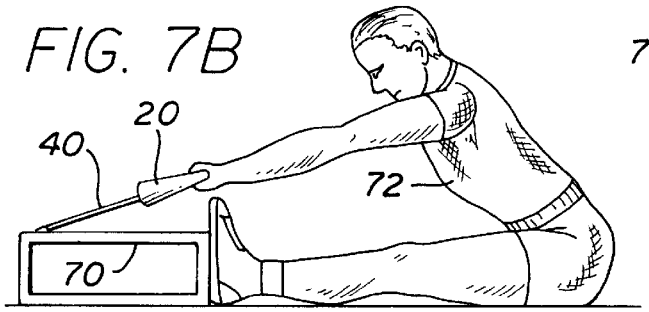
FIG. 7B
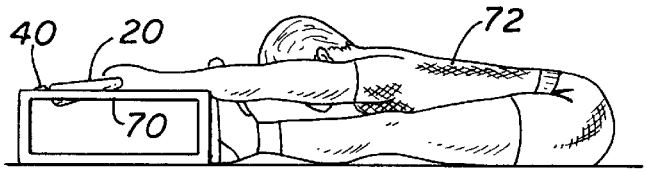
FIG. 7C
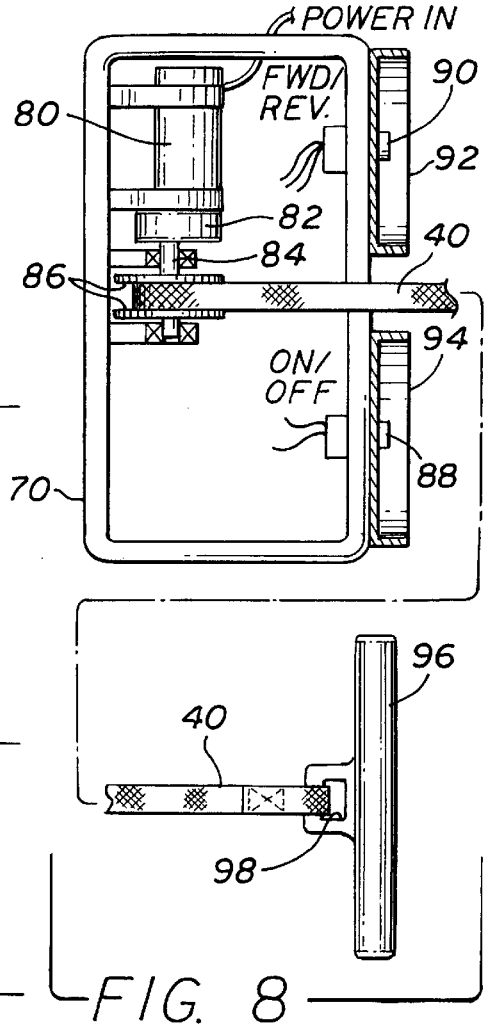
FIG. 8
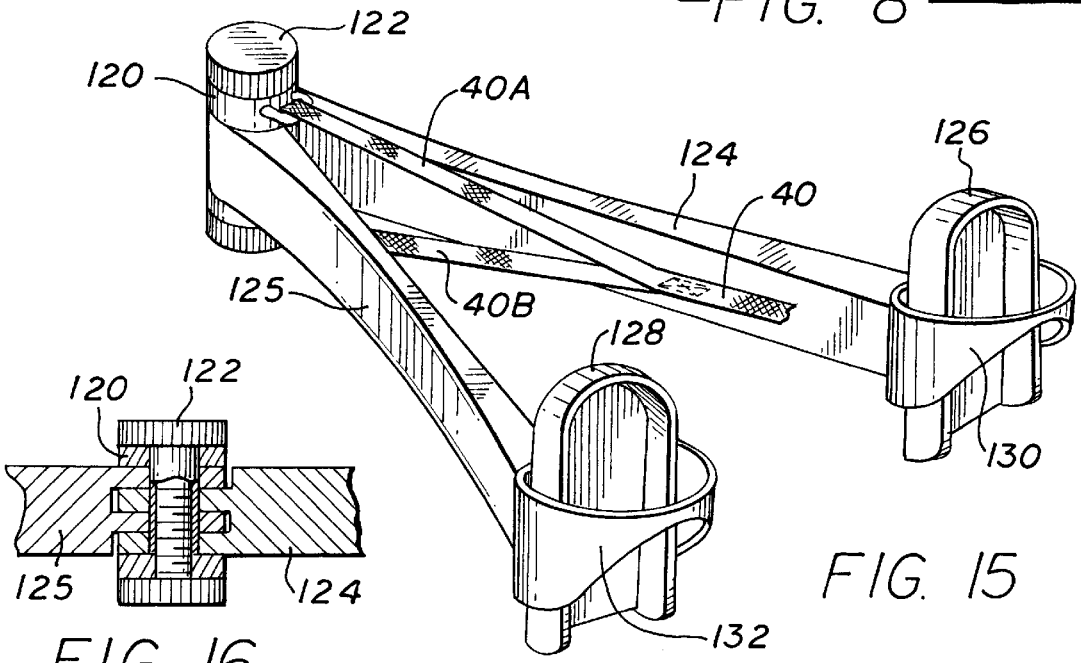
FIG. 15
FIG. 16

POWER OPERATED STRETCHING APPARATUS

This is a division of application Ser. No. 09/044,362, filed Mar. 19, 1998, now abandoned.

BACKGROUND

Exercise equipment has been designed for developing and maintaining physical fitness through a variety of exercises. Such equipment includes weight lifting machines, rowing machines, stair climbing machines, treadmills and the like. Such machines, and most exercise regimens are designed to improve the cardiovascular condition of the persons undertaking such exercise and to provide muscle building and muscle toning. Fitness centers and home exercise equipment for accomplishing these purposes are in widespread use.

Although muscle building and muscle conditioning are important in developing and maintaining physical fitness, another part of the physical fitness story is developing body flexibility. Simply stated, a flexible body works better. Good posture, decreased stress, relief of muscular and joint pain, substantially improved physical and athletic ability and an enhanced sense of well being all come with improved flexibility. Inflexibility, particularly in the lower back and hamstrings, causes low back and hamstring pain and injury. A large percentage of the adult population in the United States suffers from lower back pain; and improving back flexibility can reduce or eliminate this type of pain. Although the benefits of such flexibility are important and obvious, achieving flexibility has not been a simple task.

Inactivity and certain exercises, such as bicycle riding and running, cause the hamstring muscles to shorten. Contracting the hamstring muscles causes the pelvis to become unstable. This in turn tends to throw the spine out of alignment, constricting and pinching nerves, including the sciatica, which can cause moderate to severe pain from the lower back though the upper leg. It has been found that stretching before and after exercise reduces or eliminates the risk of injury from fitness workouts or athletic performance.

To properly stretch, the targeted muscles must be in a relaxed or passive state. Solo stretching the hamstring and muscle groups creates an inherent conflict of self-generated stretching force interfering with the passive state muscles. While dynamic or ballistic stretching is an option, it is less effective, and invites injury. Partner or trainer assisted stretching also presents problems. Most obviously, another person is required each time the stretching exercise sequence is undertaken. Beyond this, however, it is difficult, even with a trainer, to produce consistent stretching tension.

An exercising device for stretching the user's back and hamstring muscles without requiring a partner or trainer is disclosed in the U.S. Pat. No. 5,108,090 to Reed . This patent is directed to a power stretching device where the user is seated with the legs extended. A leg-immobilizing unit is provided; and an adjustable extension portion is attached pivotally to a reciprocating telescoping unit. The telescoping unit has handgrips at its upper end for engagement by the hands of the person using the device. A motor controls the reciprocal movement of the telescoping unit to cause it to move toward and away from the person using the device. Thus, as the hand grips move away from the user toward the pivot, the user is pulled forward in a bending position to effect the desired stretching of the back and leg muscles. Although the device of the Reed patent is effective for providing back stretching exercise, the mechanical parts are somewhat cumbersome and complex; and the overall device is relatively large.

Additional patents have been obtained for exercise devices for power-driven exercises. For example, a device for manipulating the legs and arms of users is disclosed in the U.S. Pat. No. 4,478,213 to Redding. The U.S. Pat. No. 5,071,117 to Mautner is directed to an electric bicycle where the movements of the person using the device are effected by the powered operation of the electric bicycle. Other devices using motor driven levers, pulleys and the like have been designed for exercising various muscles of the user. Most of these devices are relatively cumbersome, complex and expensive.

It is desirable to provide an improved power operated stretching device which overcomes he disadvantages of the prior art devices and which is small, compact and easy to use.

SUMMARY OF THE INVENTION

It is an object of this invention to provide an improved exercise device.

It is another object of this invention to provide an improved power operated exercise device.

It is an additional object of this invention to provide an improved compact, easy-to-use, power operated exercise device.

It is a further object of this invention to provide an improved power operated device for stretching the lower back and hamstring muscle groups.

In accordance with a preferred embodiment of the invention, an exercise device operates to stretch the spine/neck and leg muscles of a user. The device includes a handle which is designed to be grasped by the hands of a user. A footrest is provided; and a flexible cable is fixed at one end to either the handle or the foot rest member. The flexible cable is attached at the other end to a rotatable reel on the other one of the handle or foot rest member. A mechanism is coupled to the reel for rotating the reel to wind the cable while the handle is grasped by the user. Thus, as the user is seated on the floor or other surface, with his or her feet resting on the footrest member, the winding of the cable onto the reel while the handle is grasped causes the user to be pulled toward his or her feet, effecting the desired stretching.

BRIEF DESCRIPTION OF THE DRAWINGS

FIG. 5 is a perspective view of another embodiment of the invention;

FIG. 6 is a cross-sectional view taken along the line 6—6 of FIG. 5;

FIGS. 7A, 7B, and 7C illustrate different positions of operation of the embodiment shown in FIGS. 1 through 4;

FIG. 8 is a top partially cut-away, exploded view of another embodiment of the invention;

FIG. 9 illustrates a variation of a portion of the embodiments of the invention shown in FIGS. 1 and 5;

FIG. 10 is a cross-sectional detail taken along the line 10—10 of FIG. 9;

FIG. 11 is a cross-sectional view taken along the line 11—11 of FIG. 9;

FIG. 15 is a perspective view of a foot rest potion which may be used in place of the footrest shown in FIG. 7C;

FIG. 16 is a detail of a portion of the device shown in FIG. 15;

DETAILED DESCRIPTION

Figure 1:
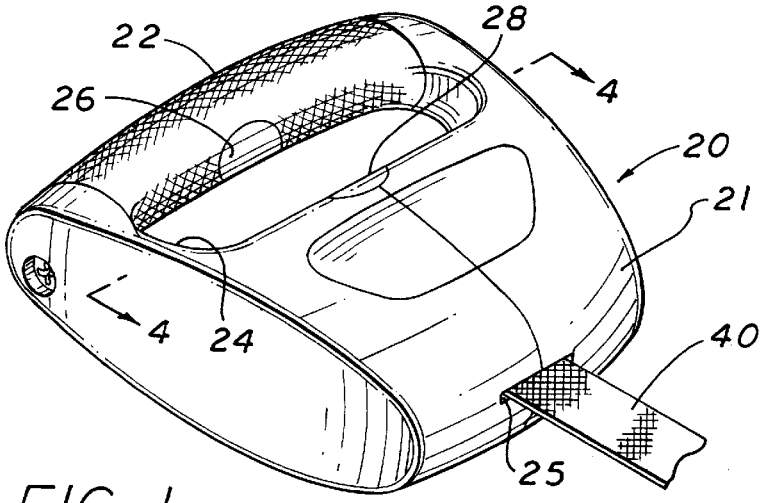
FIG. 1 is a perspective view of a preferred embodiment of the invention.
Figure 4:
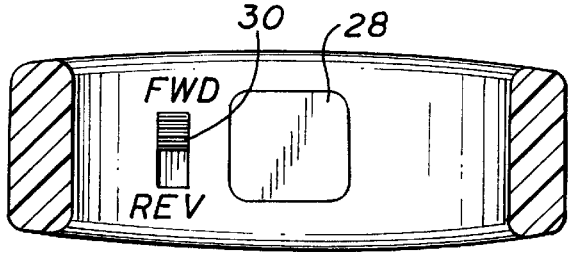
FIG. 4 is a cross-sectional view taken along the line 4—4 of FIG. 1.

Reference now should be made to the drawings, in which the same reference numbers are used throughout the different figures to designate the same components. FIGS. 1 through 4 are directed to a first preferred embodiment of the invention. FIG. 1 is a perspective view of a combination hand grip and power unit 20 used in a power operated stretching exercise apparatus. The unit 20 comprises a two-part housing having a forward housing portion 21 and a rear combination housing and handle portion 22. These two housing portions are separated by an elongated opening 24, which is shown most clearly in FIGS. 1 and 2.

Figure 2:
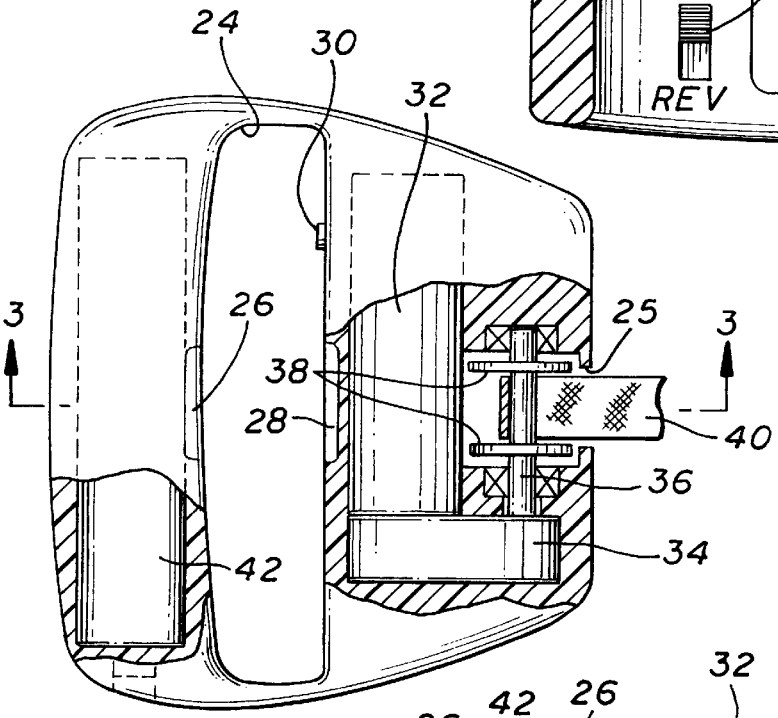
FIG. 2 is a partially cut-away top view of the embodiment shown in FIG. 1.
Figure 3:
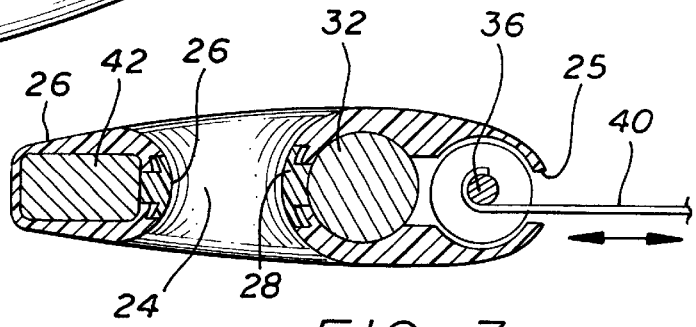
FIG. 3 is a cross-sectional view taken along the line 3—3 of FIG. 2.

As shown most clearly in FIGS. 2 and 3, the forward housing portion 21 includes a direct current electric drive motor 32 operating through a reducing gear train 34 to rotate a shaft 36, which is journaled on bearings on opposite sides of a slotted opening 25 in the front of the housing portion 21. The shaft 36 has a central portion which is defined on both sides by a pair of circular flanges 38 to form a take-up reel for a flexible cable, illustrated in FIGS. 1, 2 and 3 as a flat elongated strap 40 made of nylon or other suitable material. In place of the flat strap 40, a cable of circular cross section also made of suitable high strength material, such as nylon or the like, may be used. The rear portion of the device 20 comprising the handle 22 is hollow and contains batteries 42 for operating the direct current motor 32. An on/off switch 26 is located in the center of the handle 22, facing the opening 24, as shown most clearly in FIGS. 1, 2 and 3. On the opposite side of the opening 24, a forward/reverse switch 30 is provided, along with a brake switch 28 on the forward housing portion 26.

Whenever the on/off switch 26 is depressed to effect a circuit connection between the battery 42 and the direct current motor 32 through a conventional circuit (not shown), the motor 32 is operated to rotate in the direction selected by the forward/reverse switch 30 in a conventional manner. The electrical circuit for interconnecting the batteries 42 and the motor 32 through the switches 26 and 30 may be of any suitable standard type for controlling the operation of the motor 32.

When the motor 32 is operated, the reel 38 is rotated to wind (or unwind) the tape 40 at a relatively slow rate on the take-up reel comprised of the shaft 36 and the flanges 38. The actual rate at which the tape 40 is wound on the reel 38 typically is pre-established and is a fixed rate of rotation of the shaft 36, based upon the manufacturing parameters built into the system. The motor 32, however, typically rotates at a significantly higher rotational speed than the speed of rotation of the shaft 36, since the shaft 36 is driven through the speed-reducing gear train 34. The gear train 34 is selected to provide a relatively high torque on the shaft 36 (typically on the order of 70 pounds to 100 pounds); so that the device is capable of pulling a fairly significant amount of weight without stalling the motor 32.

Reference now should be made to FIGS. 7A, 7B and 7C for the manner in which the unit shown in FIGS. 1 through 4 is operated. In order to stretch or exercise the back muscles and leg or hamstring muscles, a person 72 typically is seated on the floor in the position shown in FIG. 7A. The hand grip device 20 is held in both hands, as shown in FIG. 7A; and the strap 40 extends to a fixed point on the left-hand end, as illustrated in FIGS. 7A through 7C, of a foot rest box or other suitable foot rest device 70. As shown in FIGS. 7A through 7C, the feet of the user 72 are placed firmly against the edge of the foot rest box 70.

Once the user is in the position shown in FIG. 7A, the switch 26 is turned on to rotate the take-up reel 36/38 by the operation of the motor 32 in the manner described previously. This causes the effective length of the strap 40, between the unit 20 and the fixed point at which it is connected on the foot rest 70, steadily to be reduced. For effecting a stretching to increase flexibility of back muscles, neck muscles and the hamstring muscles of the leg, the user 72 relaxes in the position shown in FIG. 7A and holds onto the handle portion 22 of the device 20, as described. As the take-up reel winds up the strap 40 the user is pulled progressively into the positions shown in FIGS. 7B and 7C for a user who has a very flexible back and leg muscles. The ultimate position is shown in FIG. 7C. At any time, however, the user can stop the operation of the device and terminate the stretching position whenever the maximum stretch for that particular user 72 is reached. For example, the device may be turned off by releasing the switch 26 once the user reaches the position shown in FIG. 7B, or some other position intermediate the positions shown between FIGS. 7B and 7C. All the user 72 needs to do is sit down, grasp the handle 22, and engage the power switch 26. If the user 72 desires to have a power return to the initial sitting position, the reverse switch 30 on the device 20 is operated to the opposite position from the one used to wind up the tape 40. The tape 40 then is unwound at the same speed it was wound up. Thus, the user can gently lean back against the pull on the handle 30 and return back to the position shown in FIG. 7A. The operational direction of the motor then again may be reversed, causing the positions shown sequentially in FIGS. 7A through 7C to be reached.

It should be noted that the device provides its most effective muscle stretching conditioning with users who are relaxed and who allow the power take up of the tape 40, under the operation of the motor 32, to accomplish all of the "work". It has been found that a very few 30 second or 60 second stretches on the same day can improve the stretching reach of most persons by 8" or more, the average shortfall for most persons to touching their toes.

FIGS. 5 and 6 are directed to an alternative embodiment of the invention, which operates in the same manner as the one shown in FIGS. 1 through 4. In the device of FIGS. 5 and 6, however, the housing for the motor and batteries is an elongated one, in which the batteries are located at one end of a hand grip/housing device 50 and the motor is located at the other end. In the device shown in FIG. 5, the tape 40 extends through a slot 67 in the front of a center section 52 of the device. An on/off switch 68 is located on one side of a hand grip portion 54; and a motor reversing switch or a braking switch 69 is located on the front side of another hand grip portion 56. Caps 57 and 59 are provided on the ends of the hand grip portions 54 and 56, respectively, to permit access to the interior of the device.

The portion 56 houses a direct current motor 60 and a gear box 62 driven by the motor, with a shaft 64 extending from the gear box to and across the center of the section 52 to a bearing set opposite the hand grip portion 54. The hand grip portion 54 in turn contains batteries 58, which are connected through a suitable conventional circuit (not shown) to the motor 60 through the on/off switch 68 and the reversing switch 69 in a conventional manner. A pair of flanges 66 on opposite sides of the center slot 67 and mounted on the shaft 64 form a take-up reel for the cable or tape 40, operating in the same manner as the take-up reel 36/38 of the embodiment shown in FIGS. 1 through 4. The device of FIGS. 5 and 6 operates in the same manner as the device of FIGS. 1 through 4 and can be used in place of the device 20 shown in FIGS. 7A through 7C to operate in exactly the same manner as described above in conjunction with the embodiment of FIGS. 1 through 4.

FIG. 8 illustrates an alternate to the embodiments shown in FIGS. 1 through 6. In the embodiment of FIG. 8, a simple fixed handle 96, with a strap connecting loop 98 attached to it, has a fixed end of the take-up cable or tape 40 attached to it. No motors and no batteries are provided in the handle 96 of the embodiment shown in FIG. 8. In the FIG. 8 embodiment, however, the foot rest 70 is provided with an electric motor 80 and a gear reducing set 82 for rotating a shaft 84, to which a pair of spaced flanges 86 are attached to form a take-up reel for the opposite end of the flexible cable or flexible tape 40. An on/off switch 88 is located on one side of a foot rest 94; and a forward/reversing switch 90 is located adjacent another part of a foot rest 92 affixed to the front side (the right-hand side as viewed in FIGS. 7A to 7C) of the foot rest device. Power for the motor 80 may be obtained from batteries in the same manner as the power for the devices of FIGS. 1 through 6 is obtained, or, since the foot rest portion 70 typically is located in a fixed relative position within whatever room the device is used in, power may be obtained from the conventional household circuitry for operating the motor 80. The device of FIG. 8, however, operates to effect the stretching exercise illustrated in conjunction with FIGS. 7A to 7C in the same manner as the devices of the embodiments of FIGS. 1 through 4 and FIGS. 5 through 6.

FIGS. 9 to 14 illustrates a variation of a foot rest portion of the device which may be used in conjunction with either of the two embodiments shown in FIGS. 1 through 4, or FIGS. 5 and 6. Instead of a fixed foot rest 70 of the type described above in conjunction with FIGS. 7A through 7C, the device of FIGS. 9 to 14 has a base portion 100 to which one end of each of a pair of elongated lever arms 102 and 106 is pivotally connected. The arms 102 and 106 are spaced apart at varying distances by a movable bar 108, which extends between them and which is movable in a channel or slot on the facing inner sides of each of the bars 102 and 104. The opposite ends (the right-hand ends shown in FIG. 9) of the lever arms 102 and 104 each have a pair of leg-engaging or thigh-engaging members 110 and 112 which are designed to fit on the insides of the left-hand and right-hand legs, respectively, of a user such as the user 72 when the user is seated on the floor.

The bar 108 is attached at its midpoint to a cable 106, which passes over a pulley 114 located in the base portion 100. The opposite end of the cable passing over the pulley 114 then is attached to the end of the flexible tape 40, as illustrated in FIG. 9. The tape 40 then extends into the housing portion 21 of the embodiment shown in FIGS. 1 through 4 or the center housing portion 52 of the embodiment shown in FIGS. 5 and 6 to operate in conjunction with the motors of those hand grip portions to effect the previously described relative shortening and extending of the effective cable length 40 between the connection to the cable 106 and the hand grip devices held by the user 72.

The device of FIG. 9 provides a dynamic tensioning in the power stretching inasmuch as simultaneous movement of the center bar 108 in the direction of the arrow "B" shown in FIG. 9, along with the shortening of the strap 40 when the take-up reel is being rotated to wind up the cable 40, takes place. When this occurs, the members 110 and 111 are moved farther apart as the bar 108 moves closer to the base portion 100, as illustrated most clearly in the dotted line representation in FIG. 14.

FIG. 11 also shows the range of rotation of the pivoted ends of the lever arms 102 and 104 in the base portion 100 to effect the outward and inward movement of the arms 102. This applies a spreading force to the legs of the user 72, simultaneously with the forward bending pull effected as the user continues to hold onto the hand grip of either the device 20 or the device 50, described previously. In all other respects, the operation of the hand grip portions of the devices 20 and 50 is the same as described previously for those devices connected to a fixed point in a foot rest device.

Figure 13:
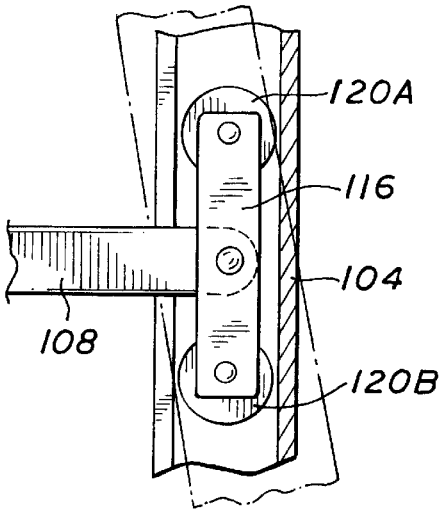
FIG. 13 is a cross section taken along the line 13—13 of FIG. 10.
Figure 14:
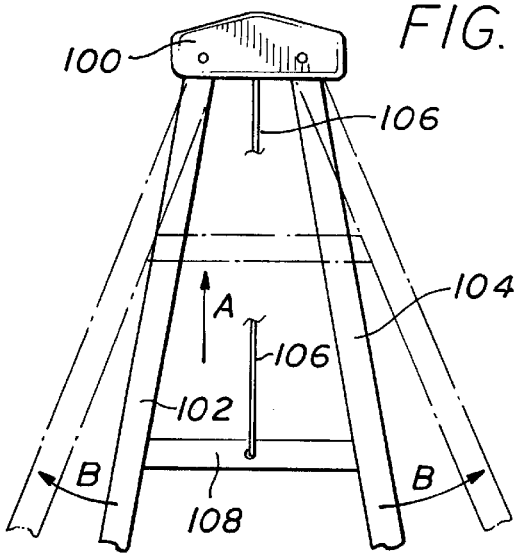
FIG. 14 is a top view of a portion of the embodiment shown in FIG. 9 showing different operating positions thereof.
Figure 12:
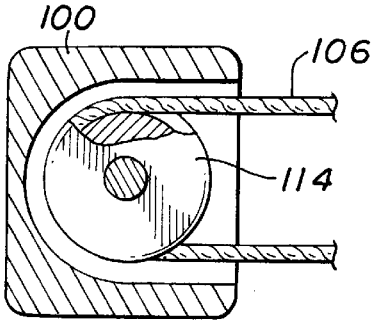
FIG. 12 is a cross section taken along the line 12—12 of FIG. 9.

FIGS. 10 and 13 illustrate the manner in which the bar 108 is supported in and moves in the slots or channels formed in the lever arms 102 and 104. Each end of the bar 108 is pivotally connected to an elongated carrier portion 116, which carries a pair of upper wheels 120A and 120B and a pair of lower wheels 122A and 122B for movement in an elongated channel located in the lever arms 102 and 104. The cross section of the channel is illustrated most clearly in FIG. 10; and the overall configuration from a top view is shown in FIG. 13.

Figure 20:
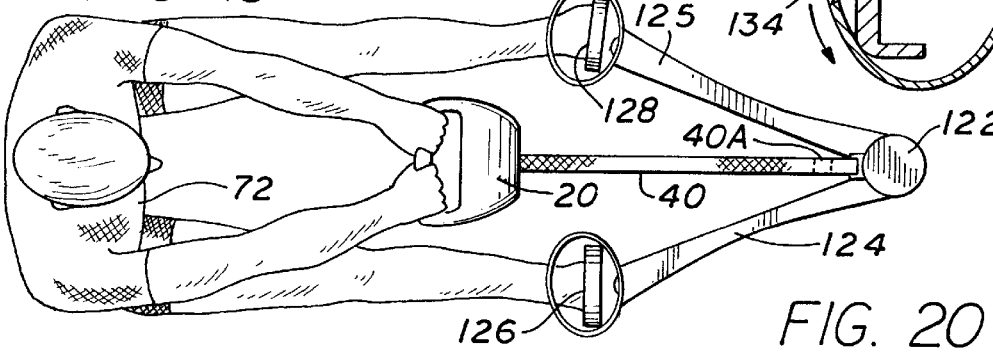
FIG. 20 is a top view of a user using the device of FIGS. 1 and 15.

FIG. 15 illustrates a variation of the box-like foot rest 70, which was shown in FIGS. 7A through 7C. The foot rest shown in FIG. 15 includes a pair of foot rest portions 126 and 128, with straps 130 and 132 for extending over the right and left feet, respectively, of a user to hold the user's feet in place against the portions 126 and 128. The foot rest portions 126 and 128 are carried on the ends of elongated arms 124 and 125, respectively. The opposite ends of the arms 124 and 125 are pivotally connected together at an interleaved junction 120, as shown most clearly in FIG. 16. A clamping bolt/nut apparatus 122 then is used to firmly hold the legs 124 and 125 against rotation when the bolt/nut 122 is tightened; but when the nut 122 is loosened, the legs may be pivoted toward one another or away from one another to obtain the most comfortable position for a user. A typical position, for example, is shown in FIG. 20.

Figure 17:
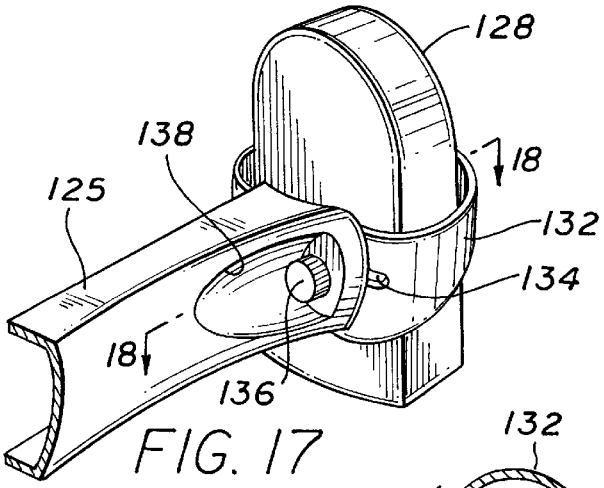
FIG. 17 is a rear perspective detail of the portion shown in FIG. 15.
Figure 19:
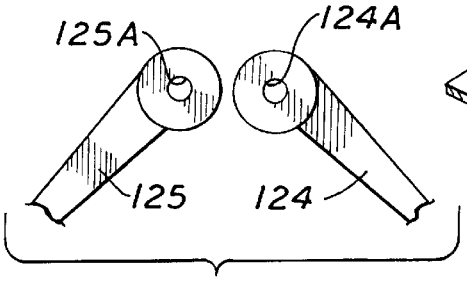
FIG. 19 is an exploded detail of a portion of the device shown in FIG. 15.
Figure 18:
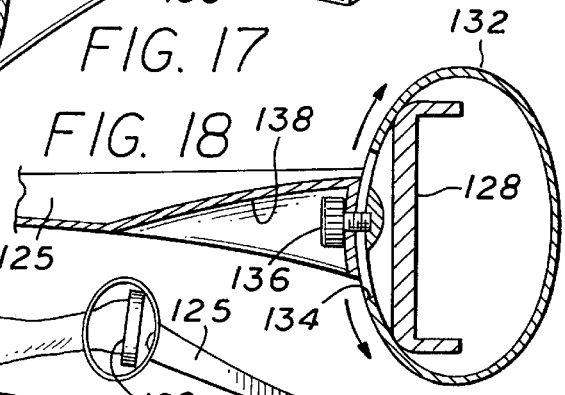
FIG. 18 is a cross-sectional view taken along the line 18—18 of FIG. 17.

FIGS. 17, 18 and 19 illustrate additional details of the device of FIG. 15. As shown in FIG. 17, a captive bolt 136 located in a cutout 138 on the arm 125 is used to adjust the pivotal angle of the foot rest 128 by means of a slot 144 formed in the rear side of the foot-holding portion 132. Angular adjustment of the device foot rest 128 is effected by means of this apparatus. A corresponding identical apparatus is provided for the foot rest 126 located on the end of the arm 124. FIG. 18 illustrates in greater detail the adjustment range and the pivotal variations which can be effected by means of the bolt 136 operating in the slot 134 of the device.

FIG. 19 illustrates part of the structural configuration of the ends of the arms 124 and 125 which fit together to align a common set of holes 124A and 125A with one another to permit passage of the bolt and nut combination 122, which secures them together as shown in FIG. 16.

When the device of FIGS. 15 through 19 is used, the end of the strap 40 opposite the end which is permanently attached by way of the extensions 40A and 40B is connected to the take-up reel 36/38 of the device 20 or the take-up reel 64/66 of the device 50. This permits operation by a person 72, as illustrated in FIG. 20, and in the same manner described above in conjunction with FIGS. 7A through 7C.

The foregoing descriptions of the various embodiments of the invention all include a stretching device in which stretching takes place between the handle 20/50 or 96 and some type of foot rest, with one end of the cable being attached to the handle and the other end of the cable being attached to the foot rest. In the embodiments shown in FIGS. 1 through 4 and 5 and 6, the tape cable is wound onto a reel located in the handle. In the embodiment of FIG. 8, the tape or cable is fixed at one end to the handle and is wound up at the other end on a reel located in the foot rest. In all of these embodiments, however, shortening of the cable is effected between the foot rest and the handle.

It also is possible to use the device shown in FIGS. 1 through 4 and 5 and 6 in a manner in which the end of the tape or cable 40 which is not wound up or released from the take-up reel in the handle is attached to some fixed point other than a foot rest. For example the opposite or free end of the tape 40 may be attached to a fixed point, such as a door knob or other suitable secure attachment point which may be located at a distance greater than the distance of the type illustrated in FIGS. 7A through 7C as part of a foot rest. With such a configuration, the user then operates the handle to cause the tape or cable 40 to be wound up in the same manner described above for the operation of the device of FIGS. 1 through 4 or FIGS. 5 and 6. The user may sit on the floor and use the cable to drag his or her body across the floor, while the user holds on to the gripping portions of the handles of the devices shown in FIGS. 1 through 4 and FIGS. 5 and 6.

Alternatively, the user may lie down on the floor, and, either lying on his or her stomach or his or her back, operate the device to drag his or her body across the floor under the pull of the tape or cable 40 to effect a stretching of the body under the pull of the cable. Similarly, the device could be provided with a chin strap or a head strap carried by the handle of either of the embodiments of FIGS. 1 through 4, or 5 and 6, to effect a floor drag of the type described above, either while the person is lying on his or her stomach or on his or her back, to effect a stretching of the neck muscles along with other muscles of the body. The operation of the take-up reel in either of the embodiments of FIGS. 1 through 4 or 5 and 6 is the same as the operation previously described in conjunction with the foot rest embodiments which have been discussed in detail above.

It should be noted that the device which is described above in conjunction with the various embodiments is compact and portable. The power portions, particularly of the embodiments shown in FIGS. 1 through 4 and in FIGS. 5 and 6, are relatively small and easily may be fitted into a briefcase or large purse. Consequently, the device can easily be moved from one location to another. It should also be noted that the various embodiments of the stretching device which have been described above and which are shown in the drawings are passive devices. In fact, for most effective use, the user relaxes to obtain maximum benefits of the stretching of the back and leg muscles which are primarily affected by use of the device.

It should be noted that while the various embodiments which have been described are primarily directed to stretching muscles and the back of the user when the user is in a relaxed state, the device also may be used for toning abductor and lumbar extensor muscles by actively pulling or resisting at certain points in the stretch movement, as the cable or tape 40 is wound and unwound on the take-up reels of the various embodiments.

By improving the body flexibility of persons using the devices of the various embodiments for short periods at regular intervals, the stretching of the back restores pelvic alignment and spinal integrity, which improves poor posture. In addition, the tendency of the back to curve or rotate from the cumulative effects of gravity and asymmetrical muscle tone is reduced. Stretching is believed also to improve circulation by relaxing muscles which become constricted and inhibit vascular blood flow. It also is well known that effective breathing is enhanced by improving posture and stretching and through the relaxing of constricted muscles which inhibit effective breathing. Finally, as is well known by professional athletes, body flexibility is one of the most effective ways to reduce injuries from exercise, athletic performance or even everyday movements like bending and turning.

The foregoing description of the preferred embodiments of the invention is to be considered as illustrative and not as limiting. Various improvements and modifications will occur to those skilled in the art for performing substantially the same function, in substantially the same way, to achieve substantially the same result without departing from the true scope of the invention as defined in the appended claims.

What is claimed is:

1. An exercise device for stretching the back, neck and leg muscles of a user including in combination:

a handle member designed to be grasped by the hands of a user;

a fixed position member;

a flexible cable fixed at one end said fixed position member and attached at the other end to a rotatable reel in said handle member; and apparatus in said handle member coupled with said reel for rotating said reel to wind said cable while said handle member is grasped by the hands of a user.

2. The combination according to claim 1 wherein said handle member comprises a first portion designed to be grasped by the hands of a user and a second portion spaced therefrom for housing said rotatable reel and said apparatus for rotating said rotatable reel.

3. The combination according to claim 2 wherein said apparatus rotating said reel includes a battery-operated electric motor and further including a battery power supply coupled with said motor.

4. The combination according to claim 3 wherein said handle member includes an operating switch for controlling the operation of said motor.

5. The combination according to claim 4 further including a control in said handle member coupled with said apparatus for winding said cable to control the direction of rotation of said rotatable reel.

6. The combination according to claim 1 wherein said handle member comprises an elongated bar and said rotatable reel is located at substantially the mid point of said bar, and said handle member is designed to be grasped by the hands of a user on opposite sides of said rotatable reel.

7. The combination according to claim 6 wherein said apparatus rotating said reel includes a battery-operated electric motor and further including a battery power supply coupled with said motor.

8. The combination according to claim 7 wherein said handle member includes an operating switch for controlling the operation of said motor.

9. The combination according to claim 8 further including a control in said handle member coupled with said apparatus for winding said cable to control the direction of rotation of said rotatable reel.

10. The combination according to claim 1 wherein said fixed position member is a foot rest member which includes a pair of spaced-apart arms pivotally attached at one end and each including a leg-engaging portion at the other end thereof, and a device for forcing said leg-engaging portions apart, and wherein said one end of said cable is fixed to said device for forcing said leg-engaging portions of said foot rest member apart to effect relative movement between said handle and said leg engaging portions.

11. The combination according to claim 1 wherein said apparatus rotating said reel includes a battery-operated electric motor and further including a battery power supply coupled with said motor.

12. The combination according to claim 11 wherein said handle member includes an operating switch for controlling the operation of said motor.

13. The combination according to claim 1 wherein said fixed position member is a foot rest member, and further including a device for adjusting the distance between the feet of a user at said foot rest member.

* * * * *